United States Patent [19]

Calehuff

[11] 3,960,654

[45] June 1, 1976

[54] SHEAR PUMP HEADBOX

[75] Inventor: Girard L. Calehuff, Hollidaysburg, Pa.

[73] Assignee: Westvaco Corporation, New York, N.Y.

[22] Filed: Aug. 19, 1974

[21] Appl. No.: 498,559

[52] U.S. Cl. ..... 162/342; 162/343; 162/367

[51] Int. Cl.[2] ..... D21F 1/18

[58] Field of Search ..... 162/342, 343, 367, 216

[56] References Cited

UNITED STATES PATENTS

| | | | |
|---|---|---|---|
| 2,627,788 | 2/1953 | Staege | 162/254 |
| 3,119,734 | 1/1964 | Jordan | 162/343 |
| 3,255,074 | 6/1966 | Salomon et al. | 162/342 |
| 3,328,236 | 6/1967 | Burgess et al. | 162/342 |
| 3,843,470 | 10/1974 | Betley et al. | 162/343 |

*Primary Examiner*—Robert L. Lindsay, Jr.
*Assistant Examiner*—George C. Yeung

[57] ABSTRACT

An improved headbox for a papermachine is provided wherein a pair of lobed rotors which extend the full width of the headbox are mounted for delivering paper making stock to rotation in the headbox. As the rotors are rotated, the lobes create a pumping action which withdraws the paper making stock from the distributor manifold and delivers it to the discharge nozzle of the headbox. Simultaneously, the lobes, acting in concert with a closely fitted housing also located within the headbox introduce a shear force on the paper making stock which produces high intensity small scale turbulence in the stock. In this regard, the lobed rotors perform two functions, (1) to deliver a uniformly metered quantity of paper making stock to the slice region, and (2) to impose a high intensity shear field on the stock to break up the flocculation that normally occurs.

4 Claims, 8 Drawing Figures

5
12
11
11
1
7
10
21
23
22
17
18
14
9
4
15
16
13
6
20
19
8
11
11
2
12
3
5

P
19
1
3
21
18
22
30
10

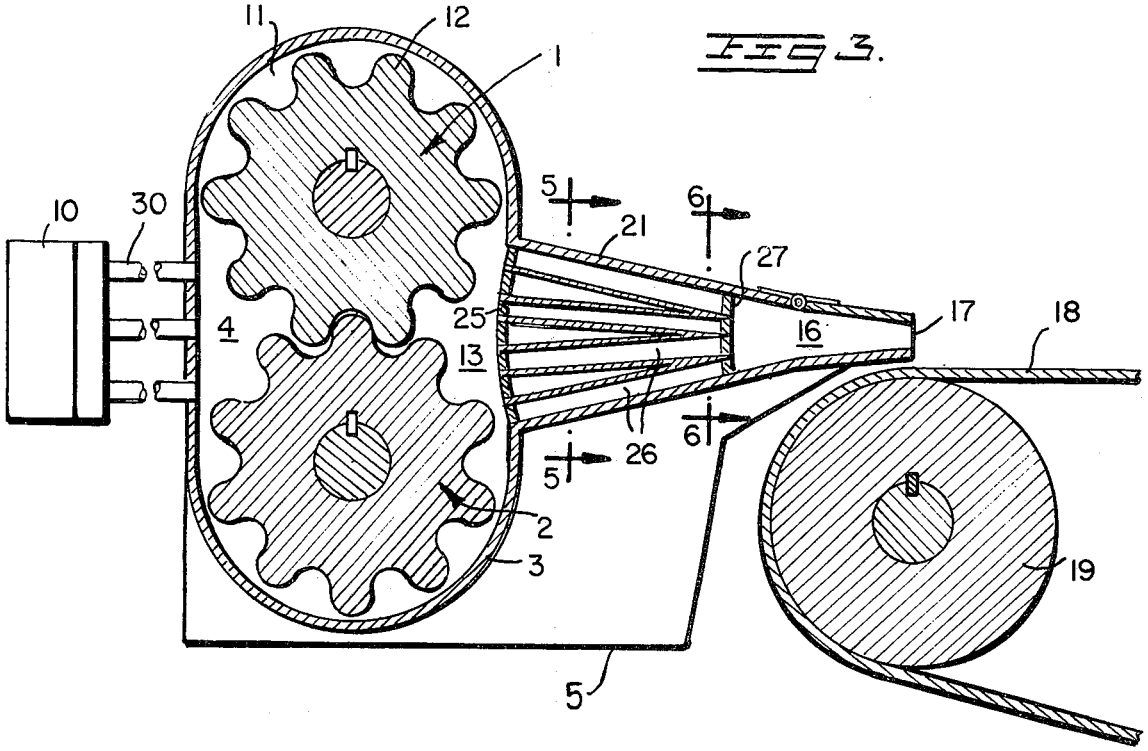
Fig 3.
Fig 5
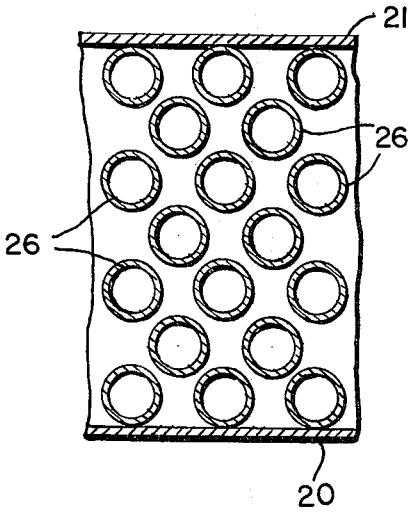
Fig 6.
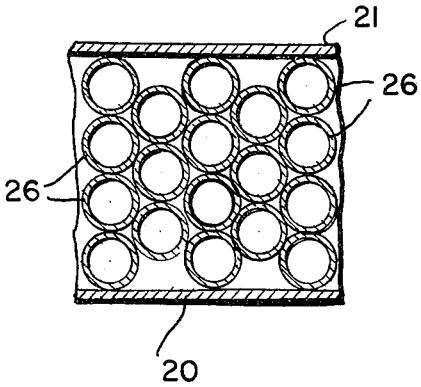

11
12
1
10
30
7
21
28
8
4
13
16
18
29
8
7
19
2
3
5

21
29
28
29
28
29
28
29
20

21
29
28
29
29
28
29
20

SHEAR PUMP HEADBOX

BACKGROUND OF THE INVENTION

The function of a papermachine headbox is to receive rawstock from the inlet manifold and to deliver the stock to the slice and forming region of a paper machine at the proper velocity, and in uniformly mixed condition so that there is a minimum of variation with respect to fiber distribution, consistency, volume and velocity.

As machine speeds and widths have increased, headbox design has become a factor of increasing importance. The old conventional open type box has given way to radically new designs. On high speed machines, the headboxes have become essentially hydraulic nozzles equipped with flow spreading devices which bring the stock in and distribute it at several points across the full width of the papermachine. The problems encountered in the design of a headbox for a high speed papermachine are in many ways similar to hydraulic problems in other industries. However, the problem of spreading paper making stock uniformly in a thin film across the width of a modern, high speed papermachine is a very difficult problem from the hydraulic standpoint alone, and when coupled with the additional demands of maintaining the suspended paper making fibers in the proper state of distribution, it becomes probably the most difficult and complex process in the whole paper making operation.

Most of the designs of modern flow systems are aimed at breaking up flocculation by increasing the intensity of turbulence and shear rate, followed by a reduction in the scale of turbulence. In the pressure type flow nozzle, perforated rolls, as well as cross current rectifiers are used to (1) create turbulence, and (2) even out velocity distribution or profile. If the intensity of turbulence at the rectifier roll or rolls is sufficiently high, flocs are broken up, and subsequently, the scale of this turbulence is then reduced by turbulence decay which follows the perforated roll.

Pressure pulsations in the approach piping to the headbox are not a factor in flocculation or fiber dispersion, but they do produce flow variations in the slice and show up as cyclic short term variations in basis weight of the paper in the machine direction. Thus it is extremely important to prevent pressure fluctuations at the slice if a uniform basis weight is to be obtained.

SUMMARY OF THE INVENTION

The present invention relates to papermachine headboxes, and particularly to an apparatus for delivering a uniform, metered quantity of stock and water to the slice region of the headbox while imposing a high intensity shear field on the stock to break up the flocculation that normally occurs.

Papermachine headboxes are conventionally provided with an inlet manifold located at one end of the papermachine for the stock flowing into the headbox. In the prior art headboxes, attempts have been made to equalize the flow velocity profile and to homogenize the pulp slurry in the headbox by placing one or more flow resistances, causing a loss of pressure, after the inlet pipe system. The task of these resistances is to correct those faults which occur in the flow supplied by the inlet pipe system. Such faults include differences in pressure and flow rate in the direction across the headbox and fiber flocculation in the pulp slurry itself. The usual solution is to place within the headbox one or more perforated rolls or rectifier rolls in such manner that the pulp slurry or paper making stock on its flow path from the input portion to the discharge portion, or the so-called slice aperture, is compelled to pass through these rotating rolls. Thus the rectifier rolls or perforated rolls serve two functions in a modern paper machine headbox. They even out non-uniformities in the approach flow to the slice region and they also introduce turbulence to break up flocs and provide a uniform formation. However, because dead or non-flow areas are created by the rotation of the rectifier rolls, they only do a partial job of flow evening and they also are very inefficient as deflocing devices since they depend for that purpose primarily on the pressure drop through the roll.

A variety of rectifier rolls have been proposed involving various combinations of hole diameters and open areas to achieve the best compromise. In other cases, the rectifier rolls have been provided with complex systems for varying the open area ratio of the rolls through adjustable devices while others have placed eddy generating devices within the slice region. And finally, proposals have been made for installing barrel or squirrel cage type rolls to produce the same purpose. However, the prior proposed systems have presented such great difficulties of design and manufacture, in the case of papermachines with a large width, and their operational characateristics have been so highly sensitive to errors in control, that designers have been compelled to look for other devices constituting solutions by which the same aims might be attained. In this regard, the headbox described in applicant's prior U.S. Pat. No. 3,328,236 was developed.

In the aforementioned patent, either all perforated rolls or a portion of them are replaced by a stationary bundle of tubes, with appropriate choice of the diameter of an individual tube and of the tube length enabling pressure drops of the desired magnitude to be obtained to effect the desired effects on the pulp flow passing through the tubes. The result of such an arrangement effectively prevents the formation of cross flows and other flow irregularities by immediately confining the flow as it leaves the supply manifold to a plurality of smaller controlled streams and then maintains this condition throughout the system of the slice where the smaller streams are ejected to form a single compound jet. As far as design is concerned, no difficulties have been encountered in connection with such a structure even in papermachines of great width and the operation of the bunched tube headbox is not dependent upon the adjustment of controls by the persons operating the machine. However, from a functional point of view, it may be seen that the velocity profile of the stock just prior to the slice is pre-defined by the tube battery since no additional equilizing elements are used. Accordingly, the present invention was designed for use either in conjunction with the bunched tube headbox described in the aforementioned patent, or for use in a headbox having a singular stock flow nozzle to provide improved defloccing and a more uniform velocity profile across the width of the papermachine. In each case, the apparatus of the present invention serves to inhibit cross flows and localized velocity differentials in the headbox while inducing the required amount of small scale turbulence to produce a pulp slurry having a uniform consistency with no evidence of flocculated fiber bundles in the suspension. Thus, it is the general object of the present invention to provide a stable and uniform velocity profile in the headbox and particularly at the slice opening of a paper making machine.

It is another object of the present invention to even out non-uniformities in the approach flow to the slice region and introduce small scale, high intensity turbulence to the stock flow to break up any flocs in the pulp suspension and produce a uniform formation.

The invention achieves the above objectives by providing at least one set or a pair of metering rolls in the headbox and immediately adjacent the slice region to perform two functions (1) deliver a uniformly metered quantity of paper making stock and water to the slice region, and (2) to impose a high intensity shear field on the stock containing solution to break up the flocculation that normally occurs.

The device of the present invention could be used as a replacement for existing headboxes on any single wire or multiple wire fourdrinier. In addition, the device of the present invention could be used in a new headbox for a new papermachine.

In carrying out the objects of the present invention, a pair of lobed rotors, which extend the full width of the headbox, are mounted for rotation within a housing located in the headbox. As the rotors are rotated, the lobes create a positive displacement pumping action which withdraws the papermaking stock from the manifold distribution system and pumps the stock to the discharge nozzle of the headbox. The manifold distribution system could take the form of those described in applicant's prior U.S. Pat. No. 3,164,513 and No. 3,171,775. However, since the general construction of inlet manifolds is well known to those skilled in the art, and since the invention herein relates primarily to an improvement in a headbox which could be used with a variety of inlet manifold constructions, the inlet manifold is shown only schematically. Similarly, the discharge nozzle of the headbox of the present invention could take any form well known in the art. However, the three embodiments illustrated and described in detail herein include a substantially fixed nozzle with and without a plurality of tapered plates, and a bunched tube discharge system such as the one fully disclosed in applicant's prior art U.S. Pat. No. 3,328,236.

DESCRIPTION OF DRAWING

FIG. 3 is a typical sectional elevational view similar to FIG. 1 showing a bunched tube stock distributor;

FIG. 5 is a partial sectional view taken along line 5–5 of FIG. 3;

FIG. 6 is a partial sectional view taken along line 6—6 of FIG. 3;

DETAILED DESCRIPTION

In carrying out the objectives of the present invention, the headbox is provided with a pair of lobed rotors which act as a high shear positive displacement pump to even out the flow distribution of the paper making stock and eliminate flocculation of the fibers. In this regard, the two rotors may both be driven externally via independent drives, or one rotor may be driven externally (as shown) and it in turn will drive the other rotor. However, in the most probable application, external meeting gears will mechanically couple the rotors. The rotors may be solid or hollow and may be equipped with controlled deflection devices to control the clearance at the nip created between the lobes of adjacent rotors or the lobes and the internal housing.

The principle of operation of the present invention depends in part on the lobed rotors and their relationship to one another but also depends upon the relationship between the lobed rotors and the internal housing of the headbox. Thus as paper making stock enters the headbox and becomes entrapped in the traveling cavities created between each lobe and the internal housing of the headbox, the shear that is caused by the relationship of a stationary housing and a moving rotor produces high intensity scale turbulence whose maximum scale or size is controlled by the size of the traveling cavity. The positive displacement pumping action of the lobed rotors is achieved by withdrawing stock from the stock receiving cavity and delivering it in the form of a succession of travelling discrete cavities in a uniform manner to the stock discharging cavity. Thus the cavities created between the lobes of the rotors which extend from side to side over the complete width of the headbox provide the desired defloccuation, create a uniform velocity profile not achieved with prior art headboxes, and at the same time serve to inhibit large scale secondary flows.

Figure 1:
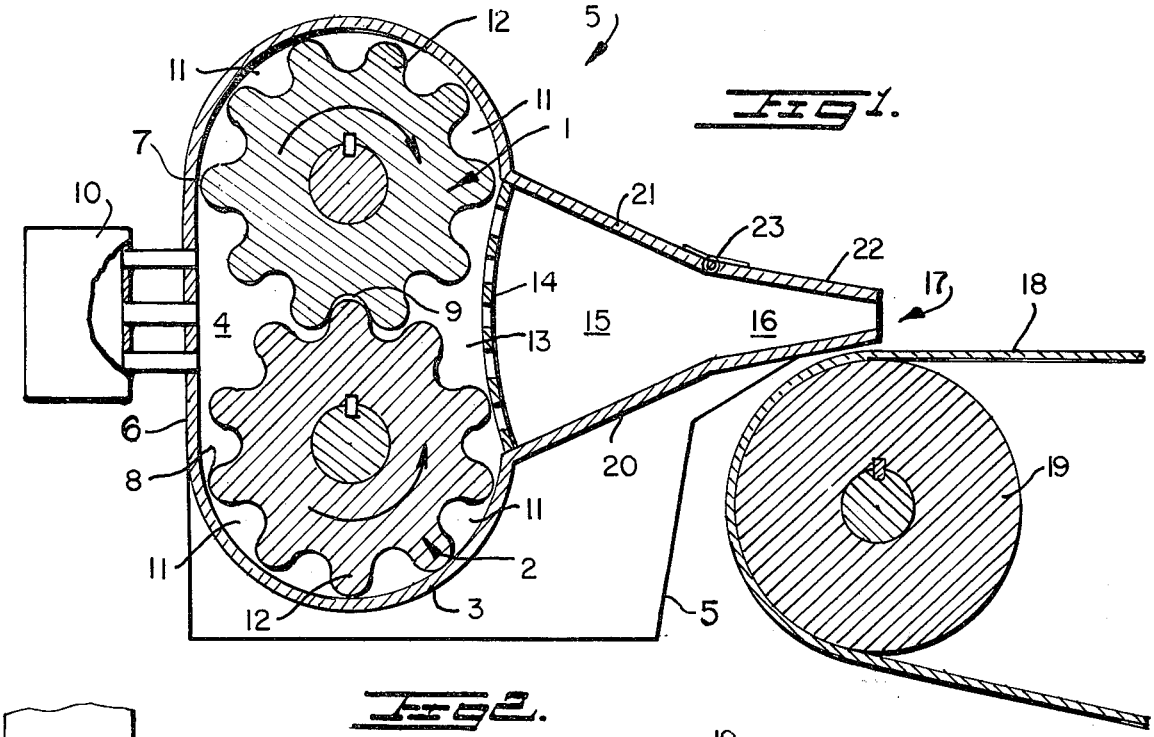
FIG. 1 is a typical sectional elevational view of the stock distribution system according to one embodiment of the present invention showing a manifold distribution system, the improved headbox construction and a fixed nozzle stock distributor.

In the embodiment of the present invention shown in FIG. 1, reference numeral 5 indicates generally a papermachine headbox having an inlet manifold 10 attached to one side thereof and a distribution nozzle 15 attached to the opposite side. Disposed within the headbox 5 is an internal housing 3 and enclosed within the housing 3 are the lobed rotors 1 and 2 which produce the shearing and pumping action of the present invention. The lobed rotors 1, 2 extend the entire width of the headbox 5 and are adapted to be driven independently or together, as noted hereinbefore in carrying out of the present invention.

The inlet manifold 10 is shown only schematically and could take the form of the inlet manifolds disclosed in applicant's prior U.S. Pat. Nos. 3,164,513 and 3,171,775. The distribution nozzle 15 is of more or less conventional design and consists of a fixed and tapered chamber leading to the adjustable nozzle 16 which defines the slice opening 17. The internal housing 3 is fitted in close proximity to the lobed rotors 1 and 2 at both the top and bottom thereof and forms a receiving chamber at 4 and a discharge chamber at 13. The receiving chamber 4 is bounded at the rear by wall 6 of housing 3, at the top and bottom by the tangent points 7 and 8 formed between the lobed rotors 1 and 2 and the housing, and at the front by the nip point 9 formed at the interface between the lobed rotors 1 and 2. Thus, paper making stock that enters the receiving chamber 4 from the manifold distributor 10 is metered into traveling cavities 11 that are alternately formed between the individual lobes 12 of the lobed rotors 1, 2 and the housing 3 as the lobed rotors rotate. The stock is then carried around the housing 3 and discharged into the discharge chamber 13. Discharge chamber 13 is bounded by the nip point 9 and tanagent points formed by the individual lobes 12 and the front of the housing 3, and by the perforated plate 14. Accordingly, as the paper making stock is carried around the housing 3 in the traveling cavities 11, a high intensity shearing action is set up between the rotors 1, 2 and the housing walls which effectively deflocs the stock and produces a uniform suspension. Meanwhile, as the stock is pumped into the discharge cavity 13, any pressure fluctuations that are inherently developed by virtue of the alternate discharging of stock from the traveling cavities 11 are dampened by the perforated plate 14. These semi-traveling cavities 11 mechanically control the bulk of the papermaking stock, inhibit large scale secondary flows and force a uniform flow into discharge chamber 13. After passing the perforated plate 14, the paper making stock having a uniform velocity profile and suspension is then delivered through the fixed nozzle 15 and past the adjustable slice lip 22 to the slice opening 17. A pivot point at 23 is provided about which the adjustable slice lip 22 is rotated to control the basis weight of the formed sheet of paper in the cross direction profile. As shown schematically in FIG. 1, the slice opening 17 is immediately above the adjacent to and fourdrinier wire 18 and the breast roll 19 is the conventional manner. The adjustable portion 16 of nozzle 15 is opened or closed to accomodate basis weight of the paper or consistency changes in the paper making stock by moving the upper lip 22 about the pivot point 23. The slice opening 17 can thus be operated collectively or selectively in the cross direction by applying any known slice adjusting device. Applicant's prior U.S. Pat. No. 3,328,236 illustrates schematically a slice adjusting device that would be suitable for the invention herein.

The lobed rotors 1, 2 are shown as being solid, however the rotors could be hollow and could be equipped with any known bending device to provide controlled deflection of the rotors within the scope of the present invention. Controlled deflection rolls are well known and used for instance in the wet presses and on the calender stacks of papermachines and in paper finishing operations. In the wet press, controlled deflection is necessary in some cases to offset the natural sagging which occurs in the press rolls. In addition, the controlled deflection press rolls can provide a variation in the moisture content of the web in the cross direction to compensate for uneven drying conditions in the dryer section of the papermachine. Similarly, by controlling the deflection of the lobed rotors 1, 2 of the present invention, one would offset the natural sagging tendency of the rolls in a headbox of great width, and the amount of paper making stock delivered in the cross direction from the discharge chamber 13 could be made more uniform. In addition controlling the deflection of the rotors 1, 2 would tend to vary the clearance in the nip 9 and between the lobes 12 of the rotors 1, 2 and the internal housing 3 to provide gross cross directional flow adjustment. It may be seen that the lobed rotors illustrated in FIG. 1 function substantially like a positive displacement external gear pump. However, the invention herein is not limited to the specific shape or mode of operation that is characterized by an external gear pump. For instance, the lobed rotor construction disclosed could readily be altered and formed like a positive displacement vane pump where the space between the housing and rotor is divided by flat vanes. In its vane pump modified form, the invention herein would trap a fluid suspension, such a paper making stock, between the vanes and the housing wall and then pump the stock from the inlet manifold to the stock distribution nozzle. In like manner, the shear pump disclosed herein could take the form of a lobed-element pump or an internal gear or Gerotor pump. In the former type pump the construction is similar to a gear pump but one having an unusual gear shape. In the latter pump, the gears are mounted concentrically with both gears being driven and the inner gear having one less tooth than the outer gear. Positive displacement pumps of the type disclosed above are well known and are shown schematically in the publication *Machine Design*, Volume 42, May 14, 1970 at page 186.

The pumping action of the device of the present invention is developed as a result of a difference in pressure between the receiving chamber 4 and discharge chamber 13 that is created by the rotation of lobed rotors 1, 2 in opposite directions to mesh at the nip point 9. Thus with top rotor 1 rotating in a clockwise direction and bottom rotor 2 rotating in a counter clockwise direction, papermaking stock enters the receiving chamber 4 which has a low pressure created at the outgoing area of nip 9 where the individual lobes 12 meet. As the lobes separate from their meshed condition at 9 and move into close proximity to the walls of housing 3 at tangent points 7 and 8, traveling cavities 11 are formed between the lobes 12 and the housing 3 which receive paper making stock from receiving chamber 4. In turn paper making stock is withdrawn from the inlet manifold distributor 10 into the low pressure area of receiving chamber 4. Meanwhile, as pointed out hereinbefore, paper making stock entrapped in the traveling cavities 11 is subjected to shear conditions by its passage around the inside of internal housing 3. The shearing action creates the high intensity, small scale turbulence of the present invention that prevents flocculation of the papermaking fibers. The maximum scale or size of turbulence created is controlled by the size of the traveling cavities 11. At the opposite side of nip point 9, the intermeshing of lobes 12 at the ingoing nip and concurrent elimination of the traveling cavities 11 causes the cavities to void to discharge their stock into the discharge chamber 13 creating a high pressure region in chamber 13. Accordingly, the difference in the pressures in the receiving chamber 4 and discharge chamber 13 creates the pumping action mentioned before and the intensity of the pumping action is determined by the variation in the nip clearance at 9, the clearance between the lobes 12 and the internal housing 3, and the rotational speed of the lobed rotors 1, 2.

For a typical installation, where the slice opening at 17 was approximately two inches, the lobed rotors 1, 2 would be approximately 20 inches in diameter with lobe heights on the order of from 1.0 to 3.0 inches. Suggested dimensions for clearances in the nip region 9 and between the lobes 12 and the housing 3 would be about 1/16 inch and ⅛ inch respectively. Of course all of the dimensions and clearances mentioned above would be highly variable and dependent upon such factors as machine width and speed, the throughput of the headbox and the consistency of the paper making stock. The discharge through the slice opening 17 would be controlled by the interaction between the total head developed in receiving chamber 4 as a result of the velocity and pressure in the distributor manifold 10, and the rotational speed of the lobed rotors 1, 2. In a general manner as the lobe height is reduced to a dimension less than the slice opening at 17, the rotors 1 or 2 will be required to operate at higher rotational speeds and higher intensity turbulence will be created via higher shear between the traveling cavities 11 and the internal housing 3. This inherent action is extremely desirable for existing papermachines where at a given stock consistency, larger slice openings are required for heavier basis weight papers, and particularly for the slower operating machines which have reduced agitation in the forming section and thus generally poorer formation.

Figure 2:
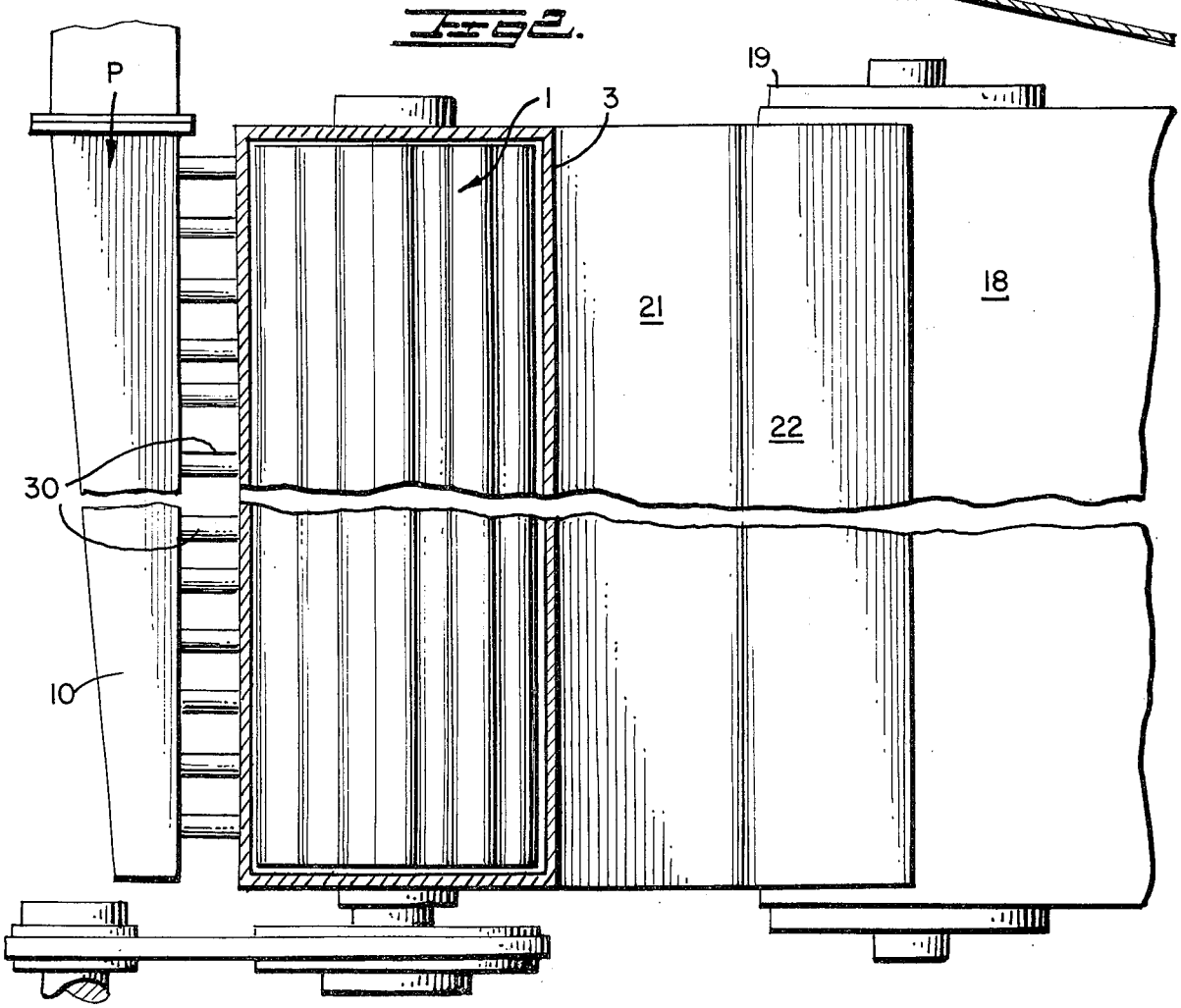
FIG. 2 is a top view of the stock distribution system of FIG. 1 with the upper part of casing 3 removed to show the lobed rotor 1.

FIG. 2 illustrates a typical installation of the headbox as it appears from a top view and shows the lobed rotors 1, 2 extending the full width of the headbox with at least one of the rotors connected to an external drive means. The manifold distributor system 10 is connected to the headbox 5 via a series of rows of pipes 30 and in the embodiment shown consists of a tapered manifold although any other conventional type of manifold could be used. Referring further to FIG. 2, it may be seen that the paper making stock indicated by the letter P flows from a suitable supply (not shown) into the tapered manifold 10. The dilute paper stock is then subjected to a flow division wherein a portion flows through each of the series of pipes 30 connecting the manifold 10 and the headbox 5. Then, because of the presence of the lobed rotors 1, 2 in the housing 3 of headbox 5, the paper stock is drawn into the low pressure region of the receiving chamber 4 and pumped through the discharge chamber 13, past the perforated plate 14 and into the nozzle 15. The critical relationship between the manifold 10 and the headbox 5 is more completely disclosed in applicant's prior U.S. Pat. No. 3,164,513 and No. 3,171,775 and since it is not a part of the present invention, it is not discussed in greater detail here.

FIG. 3 illustrates a shear pump headbox substantially as shown in FIGS. 1 and 2 except that the headbox employs the bunched tube stock delivery system disclosed in applicant's prior U.S. Pat. No. 3,328,236. Accordingly, in place of the perforated plate 14 and fixed nozzle 15 shown in FIGS. 1 and 2, FIG. 3 shows a tube sheet 25, a plurality of tubes 26 and a second tube sheet 27. In the embodiment shown in FIG. 3, the tube sheet 25 would have an open area substantially less than 50% and more on the order of 30% to inhibit the stapling of long fibers in the stock. The tubes 26 would be on the order of from ½ inch to 1 and ¼ inches in diameter and would be arranged in one, two or multiple rows. The tube sheet 27 would have an open area of at least 50% and preferably greater to promote the blending of the jets. Accordingly, stock pumped into the discharge chamber 13 of FIG. 3 by the traveling cavities 11 would pass through the tube sheet 25, the tubes 26, the second tube sheet 27 and out into the adjustable nozzle 16, then through the slice 17 and onto the wire 18 as in FIG. 1 embodiment. As more fully described in the aforementioned U.S. Pat. No. 3,328,236, the function of the tube bundle 26 is to straighten out any remaining vestiges of cross direction flow in the headbox while assuring a uniform velocity profile to the flow going to the slice.

Figure 4:
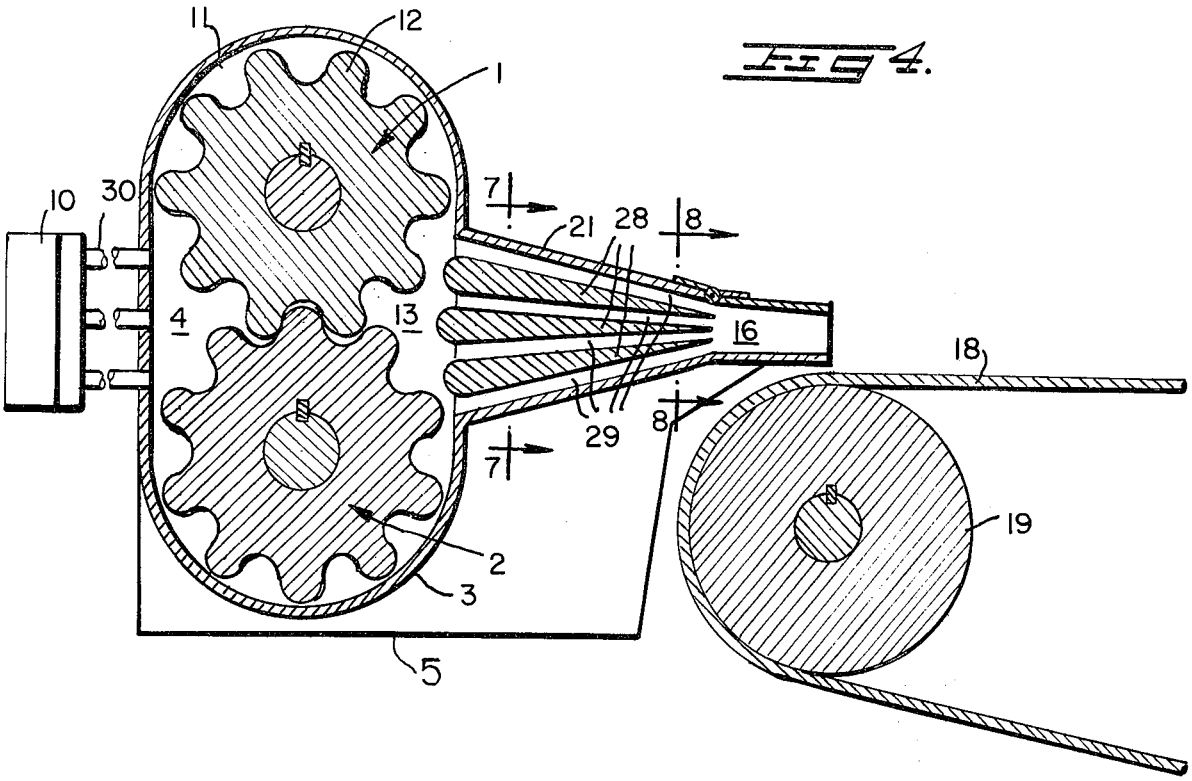
FIG. 4 is a typical sectional elevational view similar to FIG. 1 showing a tapered plate stock distributor.
Figure 7:
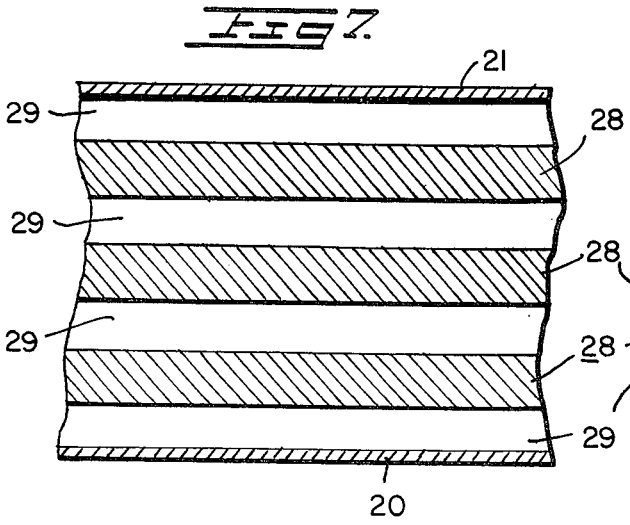
FIG. 7 is a partial sectional view taken along line 7—7 of FIG. 4; and, FIG. 8 is a view similar to FIG. 7 taken along line 8—8 of FIG. 4.
Figure 8:
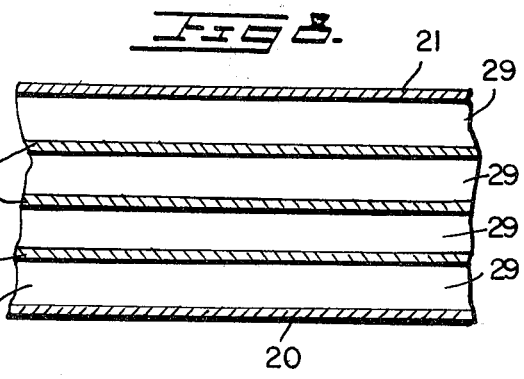

FIG. 4 shows yet another modification for the headbox of the present invention wherein the stock delivery system takes the form of a plurality of tapered plates 28 which define flow passages 29. The tapered plates 28 extend the full width of the headbox system and bound the flow passages 29 in such a way that the flow passages may either expand, contract or be parallel over the length of the plates in the machine or stock flow direction of the headbox. The open area of the assembly of tapered plates 28 at the upstream end is preferably substantially less than 50%, and on the order of around 30% to inhibit stapling of fibers over the ends of the tapered plates which bound immediately on the discharge chamber 13 of the headbox. At the downstream end of the array of tapered plates 28, the open area would be essentially 100% to promote uniform merging of the stock streams in the flow passages 29. As in the case of the bunched tube delivery system of FIG. 3, the tapered plate array would straighten out any final vestiges of large scale turbulence within the headbox.

The cross sectional views 5, 6, and 7, 8 are more or less self explanatory and are added to show the approximate relationship between the relative open areas described hereinbefore.

A stock distributor system that is designed in accordance with the principles described hereinbefore would produce the desired shearing and pumping action necessary to break up flocs in the papermaking stock and provide a uniform velocity profile at the slice. It should be appreciated however, that changes in the specific embodiments disclosed could very well be made without departing from the spirit and general concept of the invention as disclosed. Accordingly, the invention is not intended to be limited by the illustrations or description herein, or in any other manner, except insofar as may specifically be required.

I claim:

1. In a papermachine, a headbox for delivering paper making stock to said papermachine, said headbox having a top wall, bottom wall and side walls, an inlet manifold connected to one side of said headbox and a discharge manifold connected to another side of said headbox the improvement comprising:

a. a positive displacement shear pump means mounted for rotation and enclosed within a walled housing located in said headbox and extending between the side walls of said headbox, said shear pump means further comprising a pair of meshed lobed rotors the lobes of which pass in close proximity to the walls of said housing with a substantially uniform clearance from said housing walls so as to provide when rotating travelling cavities bounded by individual adjacent lobes and the walls of said housing;

b. means at the inlet manifold side of said headbox forming a stock receiving chamber bounded at two sides by the tangent points formed by the lobes of the rotors and the housing and at the other two sides by the nip point formed by the interface between the lobed rotors and the inlet manifold;

c. means at the discharge manifold side of said headbox forming a stock distributing chamber bounded at two sides by the tangent points formed by the lobes of the rotors and the housing and at two other sides by the nip point formed by the interface between the lobed rotors and the discharge manifold; and, d. means for driving said positive displacement shear pump to pump paper making stock from the inlet manifold of the headbox to the discharge manifold of headbox through the stock receiving chamber and stock distributing chamber by producing a difference in pressure between the stock receiving chamber and the stock distributing chamber when individual lobes of said lobed rotors separate from their meshed condition at the stock receiving side of said housing to accept papermaking stock and form travelling cavities of stock, which cavities are subsequently voided when the lobes later intermesh to discharge the stock contained therein into the discharge chamber.

2. A headbox according to claim 1 wherein the stock distribution manifold further comprises a perforated plate located at the discharge side of said stock discharge chamber and a fixed nozzle.

3. A headbox according to claim 1 wherein the stock distribution manifold further comprises a bunched tube stock delivery system including a first tube sheet having an open area less than 50%, a plurality of tubes and a second tube sheet having an open area greater than 50%.

4. A headbox according to claim 1 wherein the stock distribution manifold further comprises a tapered plate delivery system including a plurality of plates tapered in the direction of flow to provide an open area at the upstream end of less than 50% and an open area at the downsteam end of substantially 100%.

* * * * *